United States Patent [19]

Montagno et al.

[11] 4,046,352

[45] Sept. 6, 1977

[54] HYDRAULIC APPARATUS FOR RAISING AND LOWERING AN IMPELLER SHAFT

[75] Inventors: William J. Montagno, Rochester; Allan L. MacIntyre, Lima, both of N.Y.

[73] Assignee: General Signal Corporation, Rochester, N.Y.

[21] Appl. No.: 732,245

[22] Filed: Oct. 14, 1976

[51] Int. Cl.[2] ..... E21B 19/00

[52] U.S. Cl. ..... 254/29 R

[58] Field of Search ..... 254/29 A, 29 R, 93 R

[56] References Cited

U.S. PATENT DOCUMENTS

| | | | |
|---|---|---|---|
| 2,911,190 | 11/1959 | Creason | 254/29 R |
| 3,096,075 | 7/1963 | Brown | 254/29 R |
| 3,995,828 | 12/1976 | Orban | 254/29 A |

*Primary Examiner*—Robert C. Watson

*Attorney, Agent, or Firm*—Jeffrey S. Mednick; Harold Huberfeld

[57] ABSTRACT

A hydraulic apparatus is provided for raising and lowering the shaft of an impeller apparatus and includes a hydraulic cylinder having a piston mounted therein. A piston rod is connected to the piston and extends from one end of the cylinder. A support means for the cylinder is provided and includes a top portion, a base portion, and a hollow interior portion. The base portion is adapted to be secured to the top of the impeller apparatus. The cylinder is secured to the top portion of the support means and the piston rod extends downward into the hollow interior portion. Further means are provided for securing the piston rod to the end of the shaft, and hydraulic circuit means are placed in fluid communication with the hydraulic cylinder for activating the hydraulic cylinder to raise and lower the shaft. The hollow interior portion of the support means serves to receive the end of the shaft when the shaft is in the raised position.

1 Claim, 7 Drawing Figures

FIG. 4
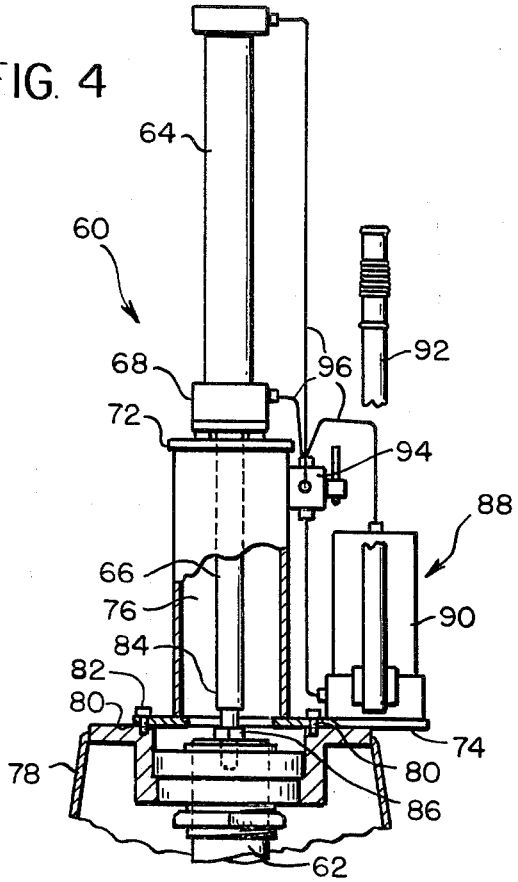
FIG. 6
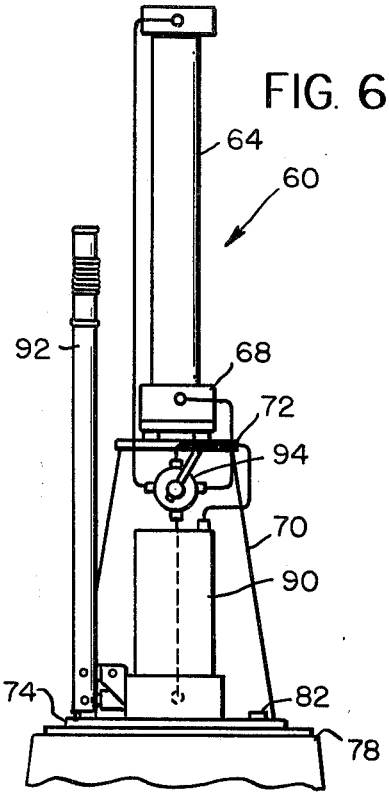
FIG. 5
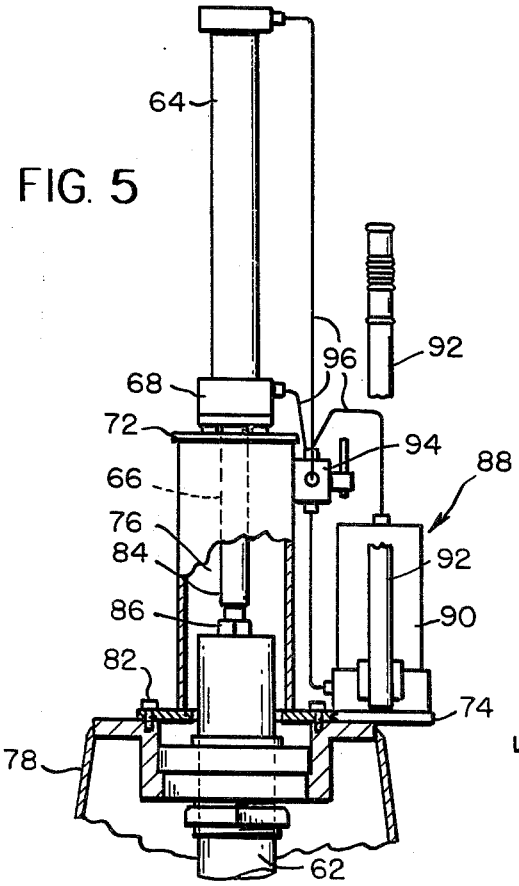
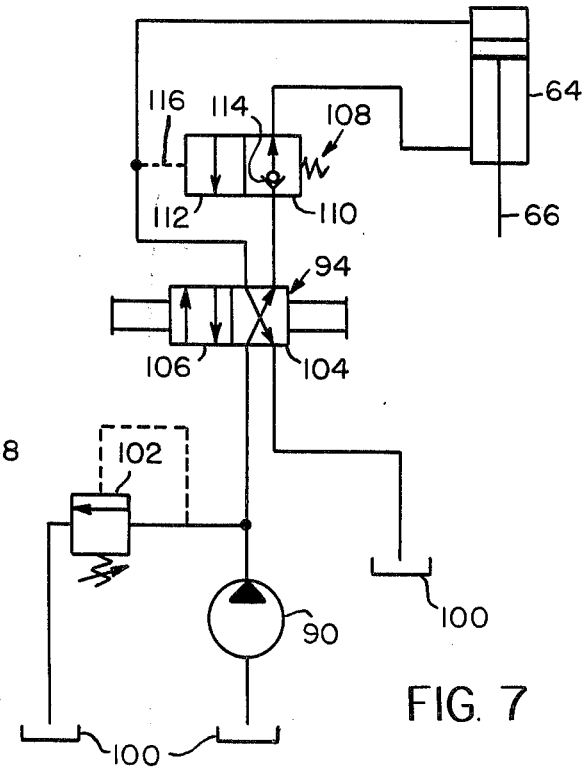
FIG. 7

HYDRAULIC APPARATUS FOR RAISING AND LOWERING AN IMPELLER SHAFT

BACKGROUND OF THE INVENTION

The present invention relates generally to a hydraulic jack apparatus and more particularly to a hydraulic apparatus for raising and lowering an impeller shaft to facilitate servicing of the impeller.

In the use of large impellers, it is periodically necessary to make various service adjustments to the impeller apparatus which necessitates raising, and in some instances subsequently lowering, the impeller shaft. For example, it is necessary to periodically change a cartridge seal assembly in many impeller apparatuses. An another example, in surface aerators it is sometimes necessary to adjust the vertical location of the impeller. These operations may necessitate raising the impeller shaft a distance on the order of six inches to a foot or more. In large impeller apparatuses the impeller shaft may weigh several thousand pounds. Accordingly, some type of lifting assembly must be employed to lift the impeller shaft.

In the past, more frequently, a screw type lifting apparatus has been employed to lift the impeller shaft. Although such screw type assemblies have generally functioned in an acceptable manner, they have exhibited some shortcomings. These screw type assemblies require the use of a ball bearing member which must carry the entire load. These ball bearing members present a rather severe limitation on the lifting capabilities of the screw type lifting assemblies. Additionally, such screw type assemblies require a significant amount of manual effort to operate the assembly and also require additional head room above the lifting assembly to allow room for retracting the screw. In some instances, on extremely large impeller apparatuses permanent hydraulic lifting assemblies have been utilized. However, to date, no hydraulic lifting apparatus has been developed which may be easily mounted atop an impeller apparatus for raising and lowering the impeller shaft.

SUMMARY OF THE INVENTION

Accordingly, a hydraulic apparatus is provided for raising and lowering the shaft of an impeller apparatus and includes a hydraulic cylinder having a piston mounted therein. A piston rod is connected to the piston and extends from one end of the cylinder. A support means for the cylinder is provided and includes a top portion, a base portion, and a hollow interior portion. The base portion is adapted to be secured to the top of the impeller apparatus. The cylinder is secured to the top portion of the support means and the piston rod extends downward into the hollow interior portion. Further means are provided for securing the piston rod to the end of the shaft, and hydraulic circuit means are placed in fluid communication with the hydraulic cylinder for activating the hydraulic cylinder to raise and lower the shaft. The hollow interior portion of the support means serves to receive the end of the shaft when the shaft is in the raised position.

OBJECTS OF THE INVENTION

An object of the present invention is the provision of a hydraulic apparatus which is capable of raising and lowering the shaft of an impeller apparatus during servicing.

Another object of the present invention is the provision of a lifting apparatus for raising and lowering an impeller shaft, which apparatus requires a minimal amount of manual effort.

A further object of the present invention is the provision of a hydraulic apparatus for raising and lowering an impeller shaft which reduces the amount of head room required above the impeller apparatus during the raising operation.

Still another object of the present invention is the provision of a hydraulic apparatus for raising and lowering an impeller shaft which is simple in construction and therefore inexpensive to manufacture.

Other objects, advantages, and novel features of the present invention will become apparent from the following detailed description of the invention when considered in conjunction with the accompanying drawings.

BRIEF DESCRIPTION OF THE DRAWINGS

FIG. 4 shows a side view in partial longitudinal cross-section of the hydraulic apparatus of the present invention.

FIG. 5 shows the apparatus of FIG. 4 with the impeller shaft in the raised position.

FIG. 6 shows a front view of the hydraulic apparatus of the present invention.

FIG. 7 shows a graphic diagram of the hydraulic circuit utilized in the hydraulic apparatus of the present invention.

DETAILED DESCRIPTION OF THE PRIOR ART

Figure 1:
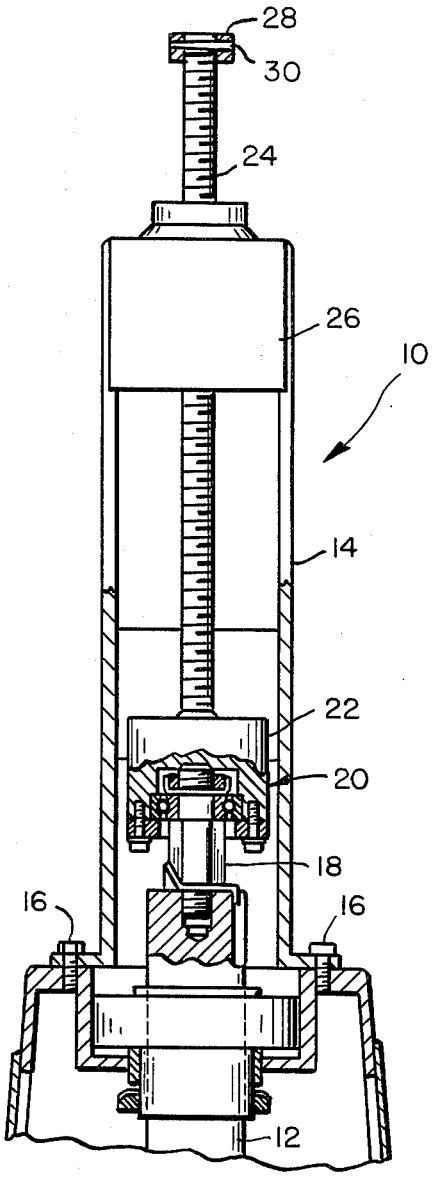
FIG. 1 (PRIOR ART)
FIG. 1 shows a partial longitudinal cross-section of a known screw type apparatus for raising and lowering an impeller shaft with the impeller shaft shown in the raised position.
Figure 2:
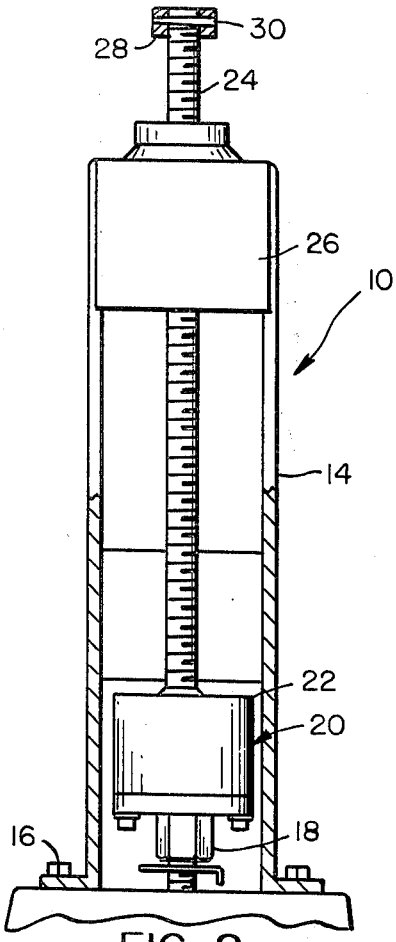
FIG. 2 (PRIOR ART)
FIG. 2 shows the apparatus of FIG. 1 with the screw in the lowered position and detached from the impeller shaft.

In order to more fully appreciate the contribution made to the art by the present invention, a more detailed discussion of the prior art is in order. This discussion will be made in connection with FIGS. 1 through 3. FIGS. 1 and 2 show a known screw type lifting apparatus, generally indicated at 10, for raising and lowering an impeller shaft 12. The apparatus 10 includes a housing 14 which may be secured to the top surface of the impeller apparatus by means of bolts 16. An adapter assembly 18 is threadingly engaged with the top of the impeller shaft 12 so as to be secured thereto. The top portion of the adapter 18 is secured to the inner race of a ball bearing assembly 20. A casing 22 is secured to the outer race of the ball bearing assembly. A long threaded screw 24 is affixed to the top of the casing 22 and is threadingly engaged with the top portion 26 of the housing 10. A nut 28 is attached to the screw 24 by means of a shear pin 30.

In order to raise the impeller shaft 12 by means of the screw type lifting apparatus 10, it is necessary to turn the nut 28 in a counterclockwise direction. As this is done, the screw 24 will move gradually upward out of the housing 14 causing the casing 22 to also move upward. The bearing assembly 20 will prevent any rotational movement from being imparted to the shaft 12, but will in turn lift the adapter 18 and the shaft 12 as the screw 24 is rotated in a counterclockwise direction. In order to lower the impeller shaft 12, the nut 28 must be turned in clockwise direction. This type of lifting apparatus is limited by the fact that the ball bearing assembly 20 must support the entire weight of the mixer shaft during the lifting process. Another problem that has been experienced is that it is relatively easy to apply too much torque to the nut 28 which results in frequent replacement of the safety shear pin 30. Finally, a significant amount of head room above the top of the housing 14 is required for retraction of the screw 24.

Figure 3:
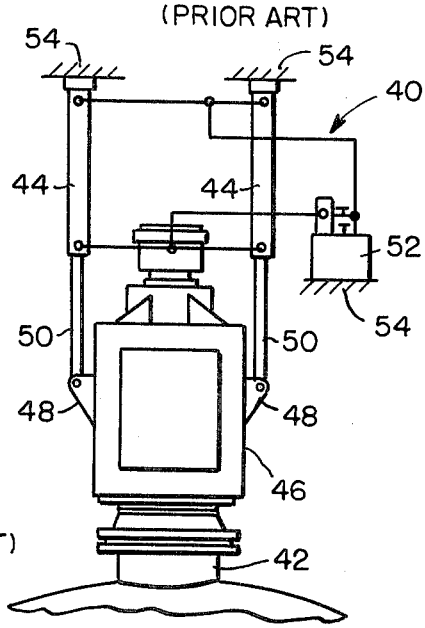
FIG. 3 (PRIOR ART)
FIG. 3 shows a known hydraulic assembly for raising and lowering a large impeller shaft.

FIG. 3 shows a hydraulic lifting assembly generally indicated at 40 for raising and lowering a large impeller shaft contained within a sleeve 42. The hydraulic lifting apparatus 40 includes a pair of hydraulic cylinders 44 each of which is securely fastened to an external support, schematically shown at 54. The impeller shaft is suspended from a bearing housing 46. A pair of ears 48 extend outwardly from the side of the housing 46. Each of the hydraulic cylinders 44 has a piston mounted therein and a piston rod 50 extending downwardly therefrom. The piston rods 50 are secured to the ears 48. The hydraulic apparatus 40 further includes a hydraulic circuit 52 including a hydraulic pump and the fluid lines and valving necessary to actuate the cylinders 44.

Thus, when it is desired to raise the impeller shaft it is necessary to mount the hydraulic cylinders 44 and the hydraulic circuity 52 on the support 54, connect all fluid lines, and connect the piston rods 50 to the ears 48. After this installation is completed, the circuit 52 may be actuated to cause the cylinders 44 to lift the shaft. As can be seen, this is a rather cumbersome and, therefore, costly procedure.

DESCRIPTION OF THE PREFERRED EMBODIMENT

The preferred embodiment of the present invention will now be described in connection with FIGS. 4 through 7. A hydraulic apparatus, generally indicated at 60, is provided for raising and lowering an impeller shaft 62. The hydraulic apparatus 60 includes a hydraulic cylinder 64 having a piston mounted therein and a piston rod 66 extending downwardly therefrom beyond the lower end 68 of the cylinder 64. The apparatus 60 further includes a support 70 having a top support 72, a base 74, and a hollow interior portion 76. The support 70 is detachably secured to the top portion 78 of the impeller apparatus, preferably by means of a plurality of mounting holes 80 in the base portion 74 and a plurality of bolts 82 adapted to fit through the mounting holes and threadingly engage the top portion 78 of the impeller apparatus.

The cylinder 64 is secured to the top portion 72 of the support 70 in such a manner that the piston rod 66 extends downwardly into the hollow interior portion 76 of the support 70. Means are provided for securing the lower end 84 of the piston rod 66 to the top end of the impeller shaft 62. This securing means is preferably a threaded member 86 which is threadingly engaged with both the end 84 of the piston rod 66 and with the top end of the shaft 62.

A hydraulic circuit means, generally shown at 88, is in fluid communication with the hydraulic cylinder 64 to activate the hydraulic cylinder for raising and lowering the shaft 62. The hydraulic circuit means 88 is securely affixed to the support 70. The hydraulic circuit means 88 includes a manual pump assembly 90 having a lever actuator 92 mounted thereon. The pump assembly 90 is securely affixed to the base portion 74 of the support 70. A directional control valve 94 is mounted on one side of the support 70 and a plurality of fluid lines 96 serve to interconnect the pump 90, the valve 94, and the cylinder 64.

A graphic diagram of the hydraulic circuit means 88 is shown in FIG. 7. The pump 90 is supplied with fluid from a reservoir 100. The output of the pump 90 is connected to the reservoir 100 through a pressure relief valve 102 and is also connected to the directional control valve 94. The directional control valve 94 is a four-way two position valve having a first position 104 and a second position 106. The control valve 94 is also connected to the reservoir 100, to the head end of cylinder 64, and to a shuttle valve 108. The shuttle valve 108 is a two-way two position valve, having a first position 110 and a second position 112. The first position 110 includes a check valve 114. The shuttle valve 108 is spring biased to position 110 and is biased by a pilot pressure signal 116 to position 122. The valve 108 is connected to the rod end of cylinder 64.

In the operation of the hydraulic apparatus of the present invention, it is merely necessary to secure the support 70 to the top portion 78 of the impeller apparatus by means of bolts 82. The piston rod 66 is then placed in firm mechanical connection with the end of the impeller shaft 62 by threading member 86 into the end 84 of the piston rod and the top of the impeller shaft 62. Then to raise the impeller shaft 62, the valve 94 is manually placed in position 104, and the lever actuator 92 is cranked. The pump 90 will then deliver fluid from the reservoir 100 through the valve 94 and the check valve 114 to the rod end of cylinder 64. As the piston is forced upward, return fluid will flow from the head end of the cylinder 64 through valve 94 and back to the reservoir 100. Since the piston rod 66 is connected to the impeller shaft 62, the impeller shaft 62 will be raised. The top end of the shaft 62 will be stored in the hollow interior portion 76 of the support 70.

In order to lower the impeller shaft 62, the valve 94 is placed in position 106, and the lever actuator 92 is again cranked. Fluid is then delivered by the pump 90 from the reservoir 100 through valve 94 to the head end of cylinder 64. As pressure in the head end of the cylinder builds up, the pilot pressure signal 116 will overcome the spring bias on valve 108 to reposition valve 108 to position 112. Fluid will then be free to flow from the rod end of the cylinder 64 through valve 108 and valve 94 back to reservoir 100.

Thus, a hydraulic apparatus is provided which is capable of raising and lowering the shaft of an impeller during servicing in a relatively simple manner. A minimal amount of effort is required to crank the lever actuator 92, thus enabling any individual to easily perform the servicing operation. Since the piston and rod 66 merely retract into the cylinder 64, a fixed amount of head room is required for the operation. This amount of head room is less than that required for the above-described screw type lifting apparatus. Since the hydraulic lifting process does not impart any rotational motion to the shaft 62, the piston rod 66 may be linked directly to the shaft 62 thus eliminating the need for any intervening ball bearing assemblies. Thus, the failure of such ball bearing assemblies no longer present a problem in the lifting process. Finally, since a screw member is no longer required, the frequent shear pin replacements are no longer necessary. Additionally, the hydraulic apparatus of the present invention may be easily and quickly installed atop an impeller apparatus. Thus, the entire lifting process has been greatly simplified and made more reliable by the hydraulic apparatus of the present invention.

While there has been described what is at present considered to be the preferred embodiment of the invention, it will be obvious to those skilled in the art that various changes and modifications may be made therein, without departing from the invention, and it is, therefore, aimed in the appended claims to cover all such changes and modifications as fall within the true spirit and scope of the invention.

We claim:

1. A hydraulic apparatus for raising and lowering the shaft of an impeller apparatus comprising:

a. a hydraulic cylinder including a piston and a piston rod, said piston rod extending downward beyond one end of said cylinder;

b. support means including a top portion, a base portion and a hollow interior portion, said base portion including means for detachably securing said support means to the top of said impeller apparatus, said cylinder being secured to the top portion of said support means, and said piston rod extending downward into said hollow interior portion, and wherein said means for detachably securing said support means to the top of said impeller apparatus comprises a plurality of mounting holes in said base portion and a plurality of bolts adapted to threadingly engage the top of said impeller apparatus;

c. means for securing said piston rod to the end of said shaft, and d. hydraulic circuit means in fluid communication with said hydraulic cylinder for activating said hydraulic cylinder to raise and lower said shaft, said hollow interior portion of said support means comprising means for receiving the end of said shaft when said shaft is in the raised position said hydraulic circuit means including a manual pump assembly having a lever actuator connected thereto, said pump assembly being affixed to the base portion of said support means.

* * * * *